US005244338A

United States Patent [19]

White

[11] Patent Number: 5,244,338

[45] Date of Patent: Sep. 14, 1993

[54] GRAVITY-STEERED GRAPPLE

[76] Inventor: Robert A. White, P.O. Box 211, Revere, Pa. 18953

[21] Appl. No.: 858,085

[22] Filed: Mar. 26, 1992

[51] Int. Cl.[5] ..... B66C 1/62

[52] U.S. Cl. ..... 414/740; 294/104

[58] Field of Search ..... 414/729, 740, 718, 728; 294/86.41, 104, 85, 67.3, 67.31, 902

[56] References Cited

U.S. PATENT DOCUMENTS

| | | | |
|---|---|---|---|
| 1,814,107 | 7/1931 | Zavatkay | 294/902 X |
| 2,435,549 | 2/1948 | Sumter | 294/104 |
| 3,599,814 | 8/1971 | Brownfield | 414/718 |
| 4,451,194 | 5/1984 | Keats et al. | 294/86.41 X |

FOREIGN PATENT DOCUMENTS

| | | | |
|---|---|---|---|
| 2118762 | 2/1971 | Fed. Rep. of Germany | 414/740 |

*Primary Examiner*—Michael S. Huppert
*Assistant Examiner*—Donald W. Underwood
*Attorney, Agent, or Firm*—Gregory J. Gore

[57] ABSTRACT

A gravity-steered grapple is created by retrofiting the boom plate of an excavator which has a longitudinally rotatable boom. The grapple includes a freely-turning, swivel joint with an axis of rotation which is offset from the center of the grapple jaws so that the center of mass of the load is likewise offset. By manipulating the angle of the boom plate with existing operator controls, the load can be steered about the swivel joint controllably through a horizontal 360-degree angle. The grapple also includes a jaw safety clamp which is movable between lock and release positions. The clamp is self-actuating and is moved into the lock position when an extension of the clamp contacts the load as the grapple is raised. The grapple is particularly useful in lifting and placing modular highway barriers.

7 Claims, 5 Drawing Sheets

GRAVITY-STEERED GRAPPLE

FIELD OF THE INVENTION

This invention relates to heavy construction lifting equipment; more specifically, to those having booms rotatable about their longitudinal axis employed for the purpose of moving modular highway barriers.

BACKGROUND OF THE INVENTION AND PRIOR ART

Modular barrier systems are extremely convenient in that they permit a particular highway barrier configuration to be re-configured, which can be often when they are used on 4-lane, road-building jobs. The barrier is moved from one lane to another quickly with equipment that lifts it slightly and slides it across the road. These modular barriers are usually in the form of molded concrete, 3-feet long, with steel plates at each end and pinned together to form long sections, which are extremely heavy and difficult to dismantle and load on flatbed trucks for transport. Heavy excavation equipment with booms that can be used for lifting are typically employed to move modular highway barriers. The most common grapple system used to grasp and lift the barrier sections has been a simple chain-and-tongs grapple. However, this method is extremely inefficient and labor intensive because it requires both an equipment operator and a laborer on the ground to place and release the tongs from engagement with the barriers. Also, because the tongs hang from a chain, the barrier load may swing as the boom swivels about its base; hence, the positioning of the barriers is not controllable, requiring further assistance from the laborer on the ground. Having a laborer handling the engagement and disengagement of the tongs, and aiding and positioning of the barrier sections creates safety hazards with this type of two-man operation.

In order to increase safety and reduce labor costs, there is a need for an economical system for lifting and positioning modular barrier sections by a single worker located a safe distance from the grapple and barrier sections. There is a further need for a safe grapple system which can quickly engage, lift, place and disengage barrier sections with speed and accuracy. Hence, it is an object of the present invention to fulfill the needs described above with an economical lift device which is safe and easy to operate, especially when lifting heavy loads such as modular highway barriers.

SUMMARY OF THE INVENTION

The above-mentioned needs in the art have been met by the present grapple invention. This grapple has been devised to fit onto the boom plate of a Gradall(R)-type, earth-moving machine. This particular piece of excavation equipment is widely used in highway construction, and it includes a feature important to the operation of the present invention; the ability of the boom to be rotated about its longitudinal axis (twist). Once the excavation bucket has been removed, the present grapple device attaches quickly and simply to the boom plate without requiring any other adaptations or remote controls for the operator. These features provide low cost and ease of operation.

As will be further described herein, the present grapple positions the center of mass of the load vertically offset from a swivel plate axis which is interposed between the grapple and the boom plate. By manipulating the up/down wrist joint at the end of the boom, together with the axial rotation (twist) of the boom, the grapple and its load can be controllably steered about the swivel plate axis through an angle of 360-degrees due solely to the force of gravity. This permits the barrier to be easily steered when carried, which is required for positioning the highway barrier sections without requiring the need for hydraulic motors or other load-turning devices. In another embodiment of the present invention, opposing grapple jaws are employed, one of which is stationary and the other freely swinging about a hinge. When used in combination with the above-described offset swivel plate, both the opening and closing of the grapple jaws as well as the turning of the grapple described above can be controlled solely by changing the angular orientation of the boom plate by the wrist joint position and/or boom axis rotation. This provides a completely controllable load-engaging, lifting and positioning system with only a few parts and no additional actuators or motors for moving the jaws or turning the load.

In yet another embodiment of the present invention, a safety clamp is provided which holds the freely swinging movable grapple jaw in a locked position when the weight of the load is applied. In this embodiment, an extension of the movable jaw, which ordinarily swings freely within a gap between the hinge and the stationary jaw, is secured against movement by a sliding clamp which moves into the gap wedging between the jaws. The clamp is slideably mounted on the stationary jaw and spring-biased in the upward release position. The fingers of the clamp contact the load when it is first engaged. As the load is lifted, the downward force of the load pulls the clamp downward, thus moving the clamp into the gap and securing the movable jaw against movement.

More specifically, the applicant has invented a gravity-steered grapple for lift equipment, comprising: a base; a load; and a boom rotatably mounted on the base for lifting the load. The boom has a longitudinal axis and means for rotating the boom about the longitudinal axis. A boom plate is connected to a free end of the boom by a wrist joint, the wrist joint being pivotal about a substantially horizontal axis. A grapple mount is affixed to the boom plate. The grapple includes a substantially vertical swivel joint connecting the mount to a grapple body; means are affixed to the grapple body for engaging the load. An offset distance is present between the swivel joint axis and the center mass of the load, whereby the movement of the wrist joint in conjunction with the rotation of the boom about its longitudinal axis causes the weight of the load to turn through an angle of 360-degrees about the swivel joint solely by the force of gravity.

DESCRIPTION OF THE PREFERRED EMBODIMENT

Figure 1:
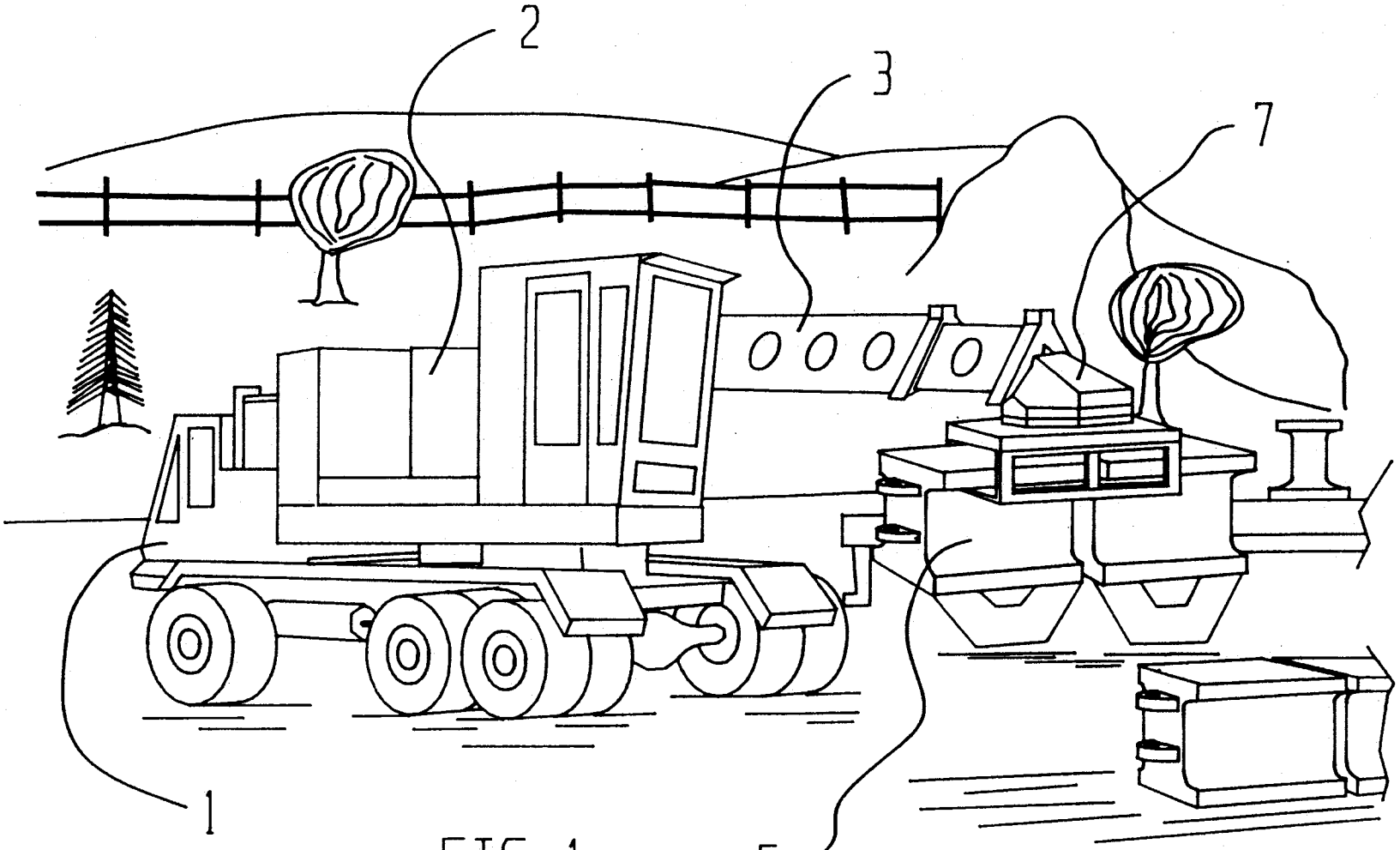
FIG. 1 shows modular highway barriers being lifted by the present grapple invention.

Referring now to FIG. 1, the present grapple invention is shown being employed in combination with a piece of highway excavation equipment, commonly known as a Gradall(R) Model 660. In this figure, the standard excavation bucket has been replaced by the present invention. This particular piece of equipment includes an operator cab and extendible boom 3 which rotates about the vehicle base 1. A boom plate 7 at the free end of the boom 3 carries the grapple mechanism of the present invention. As shown in this figure, movable barriers 5 are being lifted. It is important to the proper operation of the present invention that it be used with a lifting boom which is rotatable about its longitudinal axis (twists), such as the boom of the Gradall(R) Model 660. This is conventionally achieved by the boom rotating means of this equipment schematically shown by structure 2 shown in FIG. 1.

Figure 2:
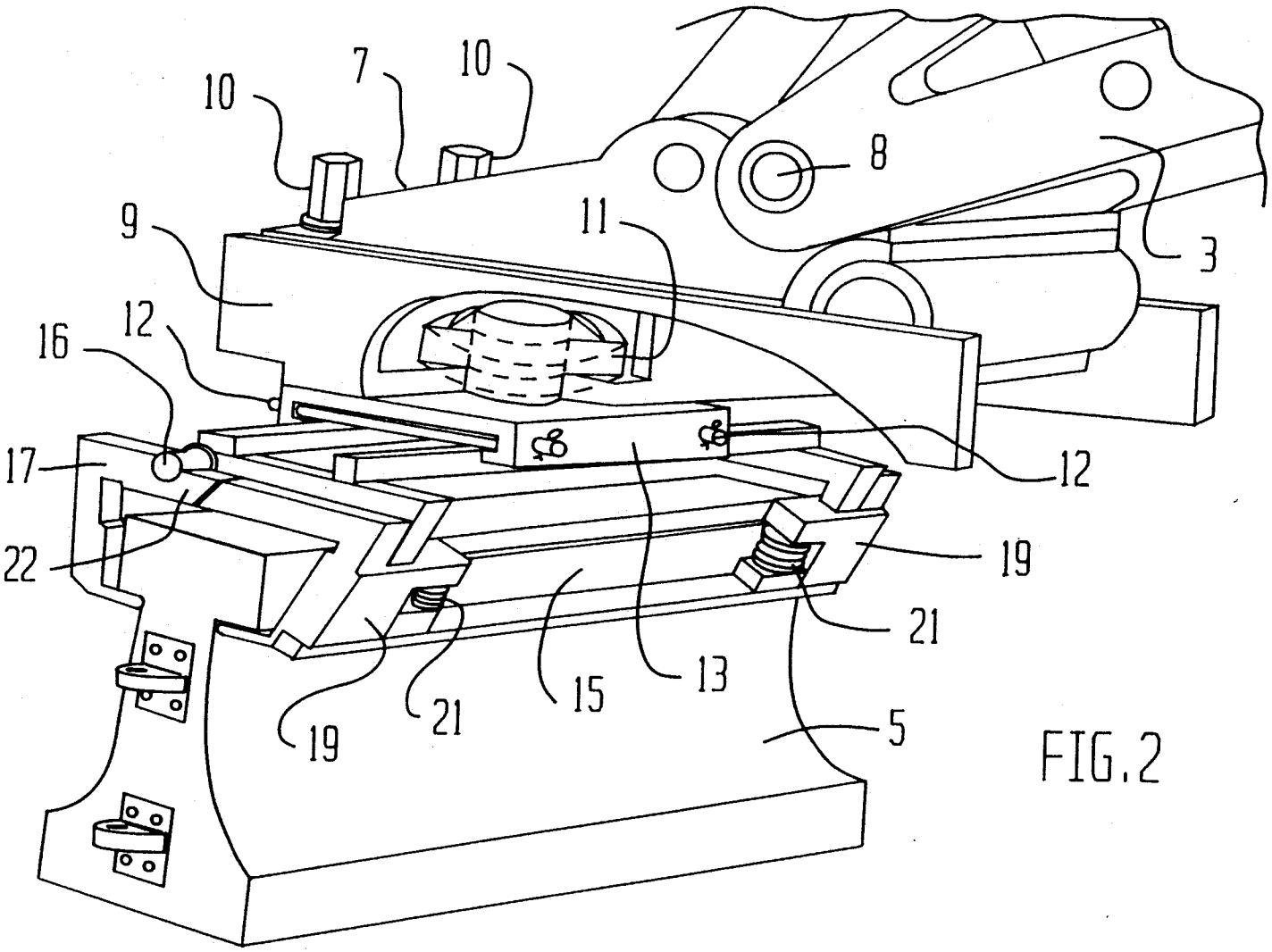
FIG. 2 is a left-side, top rear perspective view of the grapple device.

Referring now to FIG. 2, greater detail of the present invention and its various embodiments can be shown by this isometric cutaway view. The boom plate is located at the free end of the boom and includes wrist pin 8 which provides a joint about which the boom plate may articulate. This axis is perpendicular to the longitudinal axis of the boom 3. The grapple mount 9 is affixed to the boom plate by fasteners, such as bolts 10. The grapple mount rotatably holds grapple body 13 by a swivel and thrust bearing 11 which permits the grapple body to turn freely with respect to the boom. The grapple body carries a pair of jaws 17 and 15 which are releaseably affixed to the grapple body by pins 12.

The grapple jaws include a stationary jaw 15 and a movable jaw 17. The frame of the stationary jaw 15 carries a pair of clamps 19 at opposite ends of the jaw which are vertically slideable and spring-biased in the upward direction by spring means 21. Movable jaw 17 swings freely about hinge 16 and includes an extension 22 which engages the clamp when the jaws are locked. Otherwise, extension 22 is free to swing within the gap between the jaws until the end of the clamp fills this space. As will be more fully described in the other drawings, the jaws may be opened and closed due to the force of gravity, while the clamp 19 locks the jaws in their closed position about barrier 5 when the barrier is lifted and downward force is applied against the fingers of the clamp.

Figure 3:
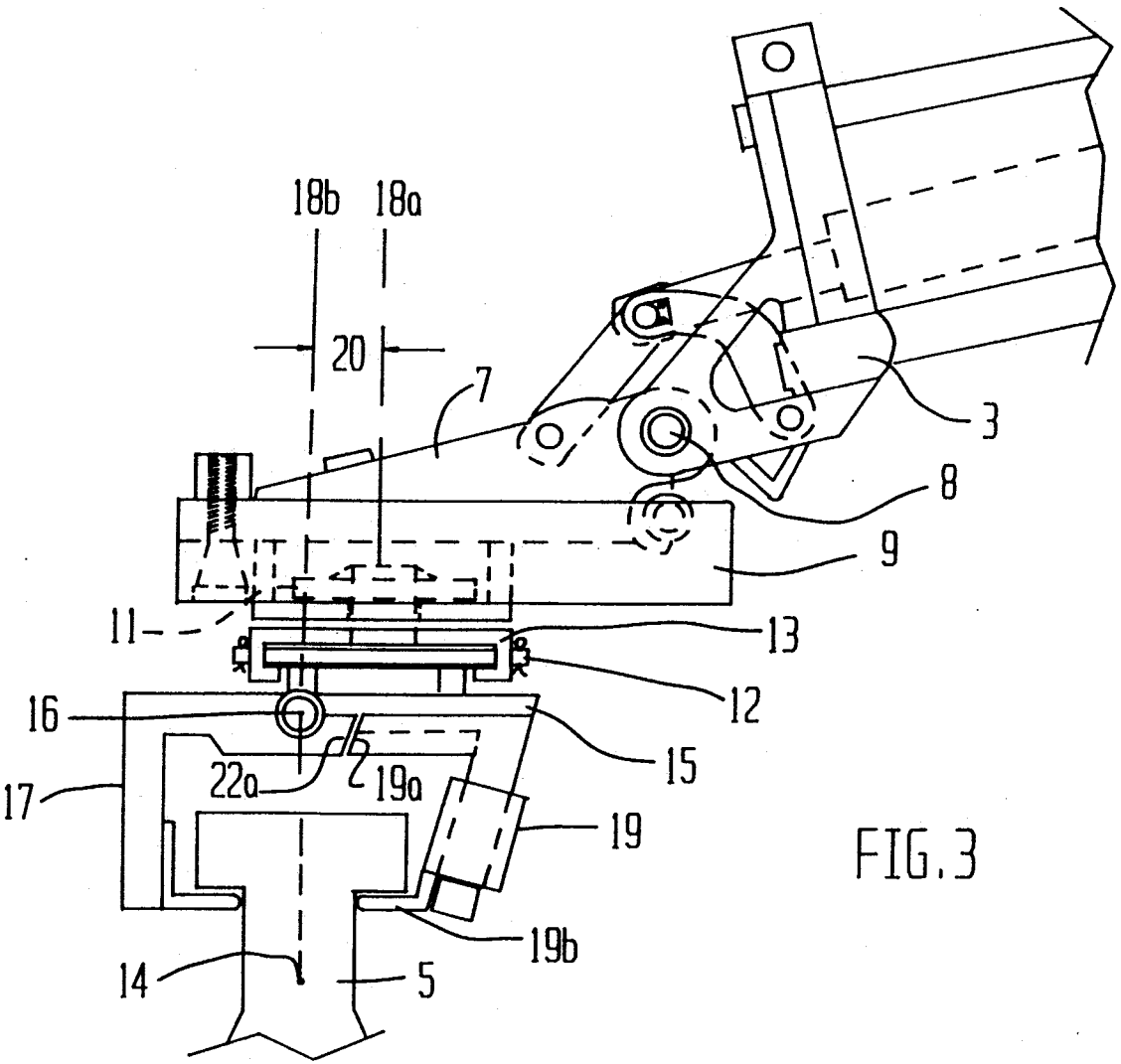
FIG. 3 is a left-side elevation.

Referring now to FIG. 3, a side view of the present device is shown with the opposing jaws 17 and 15 lifting barrier 5. An important aspect of the present grapple device is the position of the swivel axis 18*a* with respect to a line 18*b* passing through the center of mass 14 of the barrier load 5. The grapple jaw hinge joint is usually centered above the center of mass of the load during normal operation and, therefore, the mechanical offset between this joint and the swivel axis provides the desired offset from the center of mass of the barrier. As shown in this figure, these two lines are offset by a distance 20. It should be apparent to those of skill in the mechanical arts that because of this offset, when the boom plate 7 is tilted to the side by axial rotation of the boom, the load will rotate about swivel joint 11. Tilting the boom plate will cause the center of mass of the barrier load to momentarily be raised, and given the natural tendency for mechanical systems to seek their lowest energy state, the swivel will then turn in the opposite direction as the center of mass moves back downward. Starting from the particular orientation shown in FIG. 3, twisting the boom 3 either clockwise or counterclockwise about its longitudinal axis will cause the barrier and grapple system to tilt to one side, which then will cause the swivel to turn toward the opposite side. By manipulating the boom plate in this way, the barrier may be steered about the swivel axis controllably through an angle of 360-degrees.

In FIG. 3, further detail of the jaw-locking clamp 19 is shown. Barrier 5 is in its lifting position and the fingers 19*a* at the end of the clamp contact the barrier and move the clamp downward wedging it against the movable jaw so that end surfaces 22*a* and 19*a* are in abutting relationship. Hence, the jaws 15 and 17 are self-locking and secured against relative movement about hinge 8 when the barrier is lifted.

Figure 4:
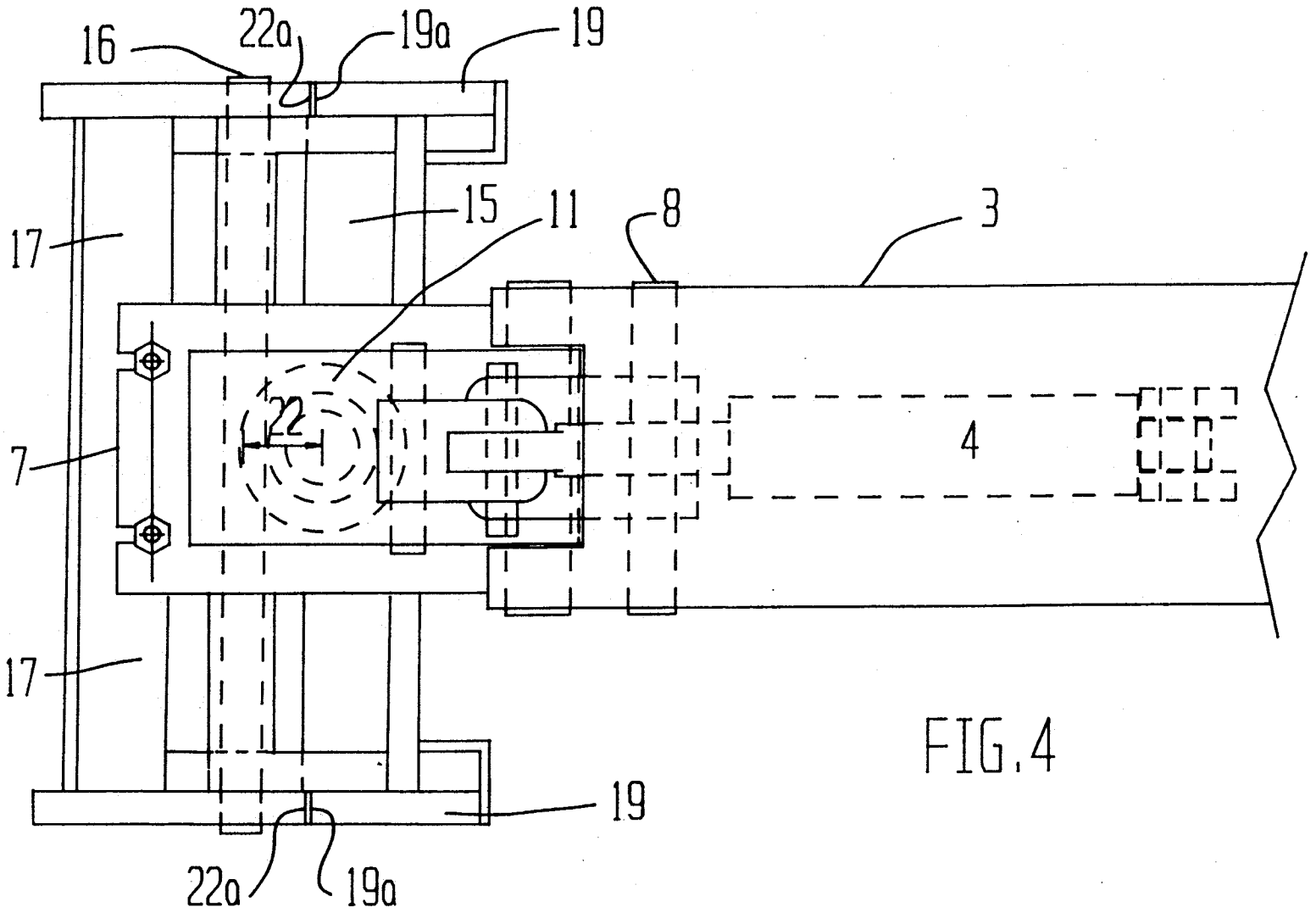
FIG. 4 is a top view.

Referring now to FIG. 4, a top view of the present device is shown without the modular barrier. From this perspective, it can also be readily seen that the axis of the swivel bearing 11 is offset from the hinge point of the jaws 16 by a distance 20 and, hence, offset from the center of mass of the load during normal operations. In this FIG., hydraulic cylinder 4 is shown which moves the angular articulation between the boom plate 7 and the end of the boom 3 through wrist pin joint 8.

Figure 5:
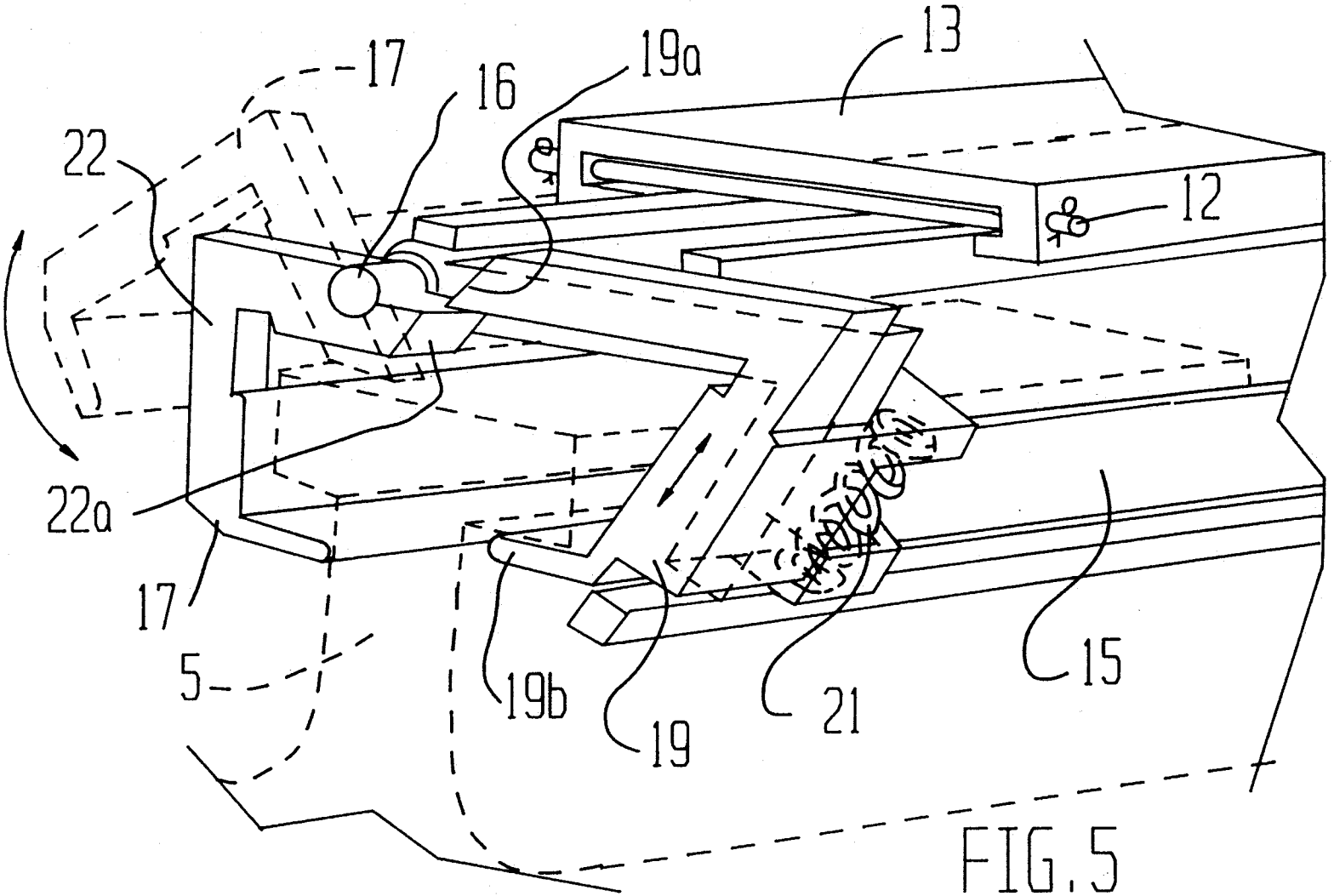
FIG. 5 is a left-side, top rear isometric view showing the modular barrier in phantom lines and the movable jaw in its closed position, and drawn in its open position in phantom lines.

Referring now to FIG. 5, the present grapple invention is shown just prior to lifting barrier 5 which, in this FIG., is shown in phantom lines. Movable jaw 17 is also shown in two positions. An open position in phantom lines, and its closed position shown in solid lines. The jaws open and close by the movable jaw pivoting about hinge 16. It will be readily understood to those in the mechanical arts that if the jaw hinge is freely swinging, as the boom plate tilts toward the jaw, the movable jaw 17 will always hang downward; therefore, by angling the boom plate so that it lifts the opposite jaw, the jaws will open relative to each other. By angling the grapple toward the barrier with the jaws open, one side of the top of the barrier may first be engaged by the movable jaw and then the jaw on the other side may be moved down around the opposite edge of the barrier by angling or tilting the boom plate in the opposite direction. In this way, the grapple jaws may be opened and then closed around the barrier section. Thus, both turning the load about the swivel joint and the opening and closing of the jaws may be accomplished by manipulating the boom plate with existing controls.

Also shown in FIG. 5, the spring-biased clamp 19 is shown in its up position and, therefore, movable jaw 17 is free to swing about hinge 16. After the jaws are closed and they begin to lift about barrier 5, the fingers 19*b* of the clamp contact the underside of the barrier and pull the clamp downward relative to the stationary jaw 15. An extension part 22 of the movable jaw 17, which extends beyond the hinge point, includes an end face 22*a* which normally swings within a gap between the hinge and stationary jaw. When the weight of the barrier moves the clamp downward, this pulls end faces 19*a* down into abutting relationship with end face 22*a* wedging the clamp into the gap, thus locking the jaws in their closed position.

It should be understood that the above description discloses specific embodiments of the present invention and are for purposes of illustration only. There may be other modifications and changes obvious to those of ordinary skill in the art which fall within the scope of the present invention which should be limited only by the following claims and their legal equivalents.

What is claimed is:

1. A gravity-steered grapple for lift equipment, comprising:

a base;

a load;

a boom rotatably mounted on the base for lifting said load, said boom mounted on the base and having a longitudinal axis and means for rotating said boom about said longitudinal, axis;

a boom plate connected to a free end of said boom by a wrist joint, said wrist joint being pivotal about an axis perpendicular to said longitudinal boom axis;

a grapple mount affixed to said boom plate, said mount including a substantially vertical free-turning swivel joint connecting said mount to a grapple body; and means affixed to said grapple body offset from said swivel joint for engaging the load comprising: a pair of opposing jaws, a first jaw rigidly affixed to said grapple body and a second jaw movable about a hinge on said body between open and closed positions so that said means holds the center of mass of said load horizontally offset with respect to the axis of said vertical swivel joint.

2. The grapple of claim 1, wherein said hinge has an axis which is offset with respect to the swivel joint axis.

3. The grapple of claim 2, wherein said movable jaw is freely swinging about said hinge such that changing the angle of the boom plate opens and closes the jaws.

4. The grapple of claim 3, further including an extension of said movable jaw which swings within a gap between the hinge and the stationary jaw.

5. The grapple of claim 4, further including a safety clamp movable between lock and release positions, said clamp occupying the gap when moved into the lock position thereby securing said extension and the movable jaw against movement.

6. The grapple of claim 5, wherein said clamp is slideably affixed to said stationary jaw, whereby said clamp is moved into the locked position by the downward movement of said clamp when it contacts the load as the grapple is raised.

7. The grapple of claim 6, wherein said load comprises modular highway barriers.

* * * * *